US007053864B1

(12) United States Patent
Lee

(10) Patent No.: US 7,053,864 B1
(45) Date of Patent: May 30, 2006

(54) HOT-PLUGGING METHOD OF DISPLAY APPARATUS

(75) Inventor: Sang-Hae Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 09/199,776

(22) Filed: Nov. 25, 1998

(30) Foreign Application Priority Data

Nov. 25, 1997 (KR) ..... P97-62917

(51) Int. Cl.
*G09G 5/00* (2006.01)

(52) U.S. Cl. ..... 345/3.4; 345/211; 345/536; 710/103

(58) Field of Classification Search ..... 345/132, 345/211, 3, 213, 11, 212, 536–538, 545, 564, 345/565, 87, 88, 535, 549, 555, 3.1, 3.4; 710/8, 10, 17, 46–48, 103; 713/100; 714/7
See application file for complete search history.

(56) References Cited

U.S. PATENT DOCUMENTS 4,760,387 A * 7/1988 Ishii et al. ..... 345/22
5,386,567 A * 1/1995 Lien et al. ..... 713/100
5,469,223 A * 11/1995 Kimura ..... 348/581
5,483,260 A * 1/1996 Parks et al. ..... 345/156
5,488,384 A * 1/1996 Uehara et al. ..... 345/3.1
5,506,602 A * 4/1996 Yokoyama ..... 345/11
5,606,716 A * 2/1997 Miyadera ..... 345/3
5,608,418 A * 3/1997 McNally ..... 345/3
5,682,529 A * 10/1997 Hendry et al. ..... 713/100
5,784,037 A * 7/1998 Inoue ..... 345/87
5,943,029 A * 8/1999 Ross ..... 345/11
5,956,022 A * 9/1999 Cheng ..... 345/213
5,963,183 A * 10/1999 Takahashi ..... 345/3
6,028,585 A * 2/2000 Ishii et al. ..... 345/132
6,028,586 A * 2/2000 Swan et al. ..... 345/132
6,037,921 A * 3/2000 Matsumoto et al. ..... 345/3
6,049,316 A * 4/2000 Nolan et al. ..... 345/698
6,097,364 A * 8/2000 Miyamoto et al. ..... 345/88

(Continued)

OTHER PUBLICATIONS

VESA Digital Flat Panel (DFP), Version 1, Video Electronics Standards Association, Feb. 14, 1999 pp. 1-16.

(Continued)

*Primary Examiner*—Henry N. Tran
(74) *Attorney, Agent, or Firm*—Robert E. Bushnell, Esq.

(57) ABSTRACT

A hot-plugging method for a display apparatus is disclosed which includes the steps of reading information pertaining to a display apparatus by a predetermined data communication upon recognizing that a display apparatus has been newly connected while a controller provided in a main body of a computer maintains judging of a new connection of display apparatus; judging whether the read information is identical to the previously stored information stored at a memory pertaining to the current display apparatus; and storing the newly read information the newly read information is not identical to the previously stored information, determining an optimal resolution corresponding to the newly connected display apparatus and transmitting the optimal resolution to a video card. By doing that, in case of replacing the display apparatus to be connected to the main body of the computer, the main body of the computer automatically recognizes the newly connected display apparatus and provides an initializing method, so that the newly connected display apparatus can be normally operated without re-operating the main body of the computer. Thus, the computer does not need to be rebooted in order to attach a new monitor.

55 Claims, 5 Drawing Sheets

U.S. PATENT DOCUMENTS

| | | | | |
|---|---|---|---|---|
| 6,247,080 | B1 * | 6/2001 | Wallach et al. | 710/302 |
| 6,263,387 | B1 * | 7/2001 | Chrabaszcz | 710/302 |
| 6,320,576 | B1 * | 11/2001 | Kim | 345/157 |
| 6,662,240 | B1 * | 12/2003 | Siefert | 710/8 |

OTHER PUBLICATIONS

Digital Visual Interface (DVI), Revision 1.0, Digital Display Working Group, Apr. 2, 1999, pp. 1-76.

* cited by examiner

HOT-PLUGGING METHOD OF DISPLAY APPARATUS

CLAIM OF PRIORITY

This application makes reference to, incorporates the same herein, and claims all benefits accruing under 35 U.S.C. § 119 from an application entitled Hot-Plugging Method of Display Apparatus earlier filed in the Korean Industrial Property Office on 25 Nov. 1997, and there duly assigned Serial No. P97-62917 by that Office.

BACKGROUND OF THE INVENTION

1. Technical Field

The present invention relates to a method of recognizing whether a display apparatus is newly connected to a main body of a computer, and more particularly to a hot-plugging method for display apparatus which is capable of judging whether a display apparatus is replaced with another by polling or interrupting.

2. Related Art

Computer systems are information handling systems that are utilized by many individuals and businesses today. A computer system can be defined as a microcomputer that includes a central processing unit (CPU), a volatile memory, a non-volatile memory such as read only memory (ROM), a display monitor, a keyboard, a mouse or other input device such as a trackball, a floppy diskette drive, a compact disc-read only memory (CD-ROM) drive, a modem, a hard disk storage device, and a printer. A computer system's main board, which is a printed circuit board known as a mother-board, is used to electrically connect these components together.

The central processing unit is often described as a microprocessor. The microprocessor is an electronic component having internal logic circuitry handling most, if not all, the data processing in the computer system. The internal logic circuitry of microprocessors is typically divided into three functional parts known as the input/output (I/O) unit, the control unit, and the arithmetic-logic unit (ALU). These three functional parts interact together and determine the power and performance of the microprocessor. The combination of the control unit and the arithmetic-logic unit can be referred to as the central processing unit. Also, the combination of the input/output unit, the control unit, and the arithmetic-logic unit can be referred to as the central processing unit.

One example of non-volatile memory is read only memory (ROM). Information stored in non-volatile memory can remain unchanged even when there is a power failure. The information stored in non-volatile memory will stay there until it is changed. Read only memory (ROM) is used to store important information such as instructions for the central processing unit (CPU). There are different types of read only memory (ROM) including electrically-erasable-programmable-read-only-memory (EEPROM) chip and flash-read-only-memory (flash-ROM). The flash-ROM can also be referred to as flash memory.

Computer systems include a basic input output system (BIOS) which is an especially important program stored in read only memory (ROM). The basic input output system (BIOS) tests a computer every time the computer is powered on. The basic input output system (BIOS) can allocate a computer system's resources automatically, making adjustments needed to accommodate new hardware. Also, the basic input output system (BIOS) governs how system board components interact.

When the computer system is powered on, the basic input output system (BIOS) immediately takes control of the computer system and its components. The first duty of the basic input output system (BIOS) is to perform a series of diagnostic routines called the power on self test (POST) routine, which ensures that every part of the computer system's hardware is functioning properly.

Consider a booting operation for a computer system using Microsoft Windows 95 as the operating system. First, a user starts the booting process by turning on a power switch to supply power to the computer system. Next, a basic input output system (BIOS) executes a power on self test (POST) to test and initialize the computer system's components. The basic input output system is software embedded on an integrated circuit located on the computer system's main board. The basic input output system also handles low-level input/output to various peripheral devices connected to the computer system. The power on self test is the part of the basic input output system that takes control immediately after the computer is turned on. The power on self test initializes the computer hardware so that an operating system can be booted (loaded). When the power on self test procedure is finished, a plug and play operation is executed if it is determined that all hardware is operating normally. A specification prepared by Microsoft and Intel that presents a mechanism to provide automatic configuration capability to Industry Standard Architecture (ISA) cards thus enabling full Plug and Play in the computer is dated 5 May 1994 and is entitled, "Plug and Play ISA Specification, Version 1.0a." During the plug and play operation, the entire computer system is scanned for new hardware.

The plug and play operation is executed every time that the computer system is booted. Now the plug and play operation shall be described in detail. At first, a configuration manager, which manages the plug and play operation, checks to determine whether a bus is being used. That is, a bus enumerator, which is a special driver managing a bus, builds a database by gathering information on peripheral devices. Next, the configuration manager uses the database built by the bus enumerator to build a hardware tree structure and stores the hardware tree structure in a memory. The hardware tree structure indicates the composition of the hardware being used in the computer system.

Subsequently, the configuration manager operates drivers of each peripheral device indicated in the hardware tree structure. After the drivers of each peripheral device are operated, a resource arbitrator, which resolves conflicts among system resources, distributes system resources to each peripheral device. Here, system resources include interrupt request lines (IRQs), input/output port addresses, memory addresses, direct memory access (DMA) channels, and more.

Lastly, the configuration manager transmits information to the bus enumerator regarding details of the distribution of the system resources. The bus enumerator transmits information regarding allowed system resources to each peripheral device connected to the bus, thereby enabling the user to utilize the peripheral devices.

Next, when the execution of the plug and play operation is completed, system files used by the Microsoft Windows 95 operating system are executed to complete the booting process of the computer system. Then the booting process of the computer system is complete.

I believe that the plug and play operation is only performed when a computer system is booted. Therefore, I have found that it can be difficult or impossible to disconnect a first display from a computer after the computer has been booted and while the computer is operating, to connect a second display to the computer, and then to use the second display with the computer, all without rebooting the computer.

SUMMARY OF THE INVENTION

An object of the present invention is to provide a hot-plugging method of display apparatus in which a main body of a computer automatically recognizes a newly connected display apparatus so as to normally operate it without re-driving the main body of the computer even though the display apparatus is replaced while the main body of the computer is being operated.

To achieve the above objects, there is provided a hot-plugging method of display apparatus including the steps of reading information on a display apparatus by a predetermined data communication upon recognizing that a display apparatus is newly connected while a controller provided in a main body of a computer maintains judging of a new connection of display apparatus; judging whether the read information is identical to the information stored at a memory on the current display apparatus; and storing the newly read information if they are not identical to each other, determining an optimal resolution corresponding to the newly connected display apparatus and transmitting it to a video card.

To achieve these and other objects in accordance with the principles of the present invention, as embodied and broadly described, the present invention provides a method, comprising: while power is being supplied to a processing unit, detecting whether a video display unit is newly coupled to a connecting unit of said processing unit, said video display unit conveying varying visual information to a user, and said processing unit processing data including the varying visual information; when said video display unit is detected as being newly coupled to said connecting unit while power is being supplied to said processing unit, reading first data corresponding to said video display unit; determining whether said first data corresponds to second data stored in a memory unit; and when said first data does not correspond to said second data stored in said memory unit, storing said first data in said memory unit and determining a resolution corresponding to said video display unit and transmitting said resolution to a video card coupled to said video display unit.

To achieve these and other objects in accordance with the principles of the present invention, as embodied and broadly described, the present invention provides an apparatus, comprising: a video display unit conveying varying visual information to a user; and a processing unit processing data including the visual information, said processing unit detecting whether said video display unit is newly coupled to said processing unit while power is being supplied to said processing unit, said processing unit reading first data corresponding to said video display unit when said video display unit is detected as being newly coupled to said processing unit while power is being supplied to said processing unit, said processing unit determining whether said first data corresponds to second data stored at said processing unit, wherein said processing unit stores said first data and determines resolution data corresponding to said video display unit and transmits said resolution data when said first data does not correspond to said second data.

To achieve these and other objects in accordance with the principles of the present invention, as embodied and broadly described, the present invention provides a method, comprising: while power is being supplied to a processing unit, detecting whether a video display unit is newly coupled to said processing unit, said video display unit conveying varying visual information to a user, and said processing unit processing data including the visual information; when said video display unit is detected as being newly coupled to said processing unit while power is being supplied to said processing unit, reading first data corresponding to said video display unit; determining whether said first data corresponds to second data stored in a memory unit; and when said first data does not correspond to said second data stored in said memory unit, storing said first data in said memory unit and determining resolution data corresponding to said video display unit and transmitting said resolution data to a first device.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to exemplify the principles of this invention.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
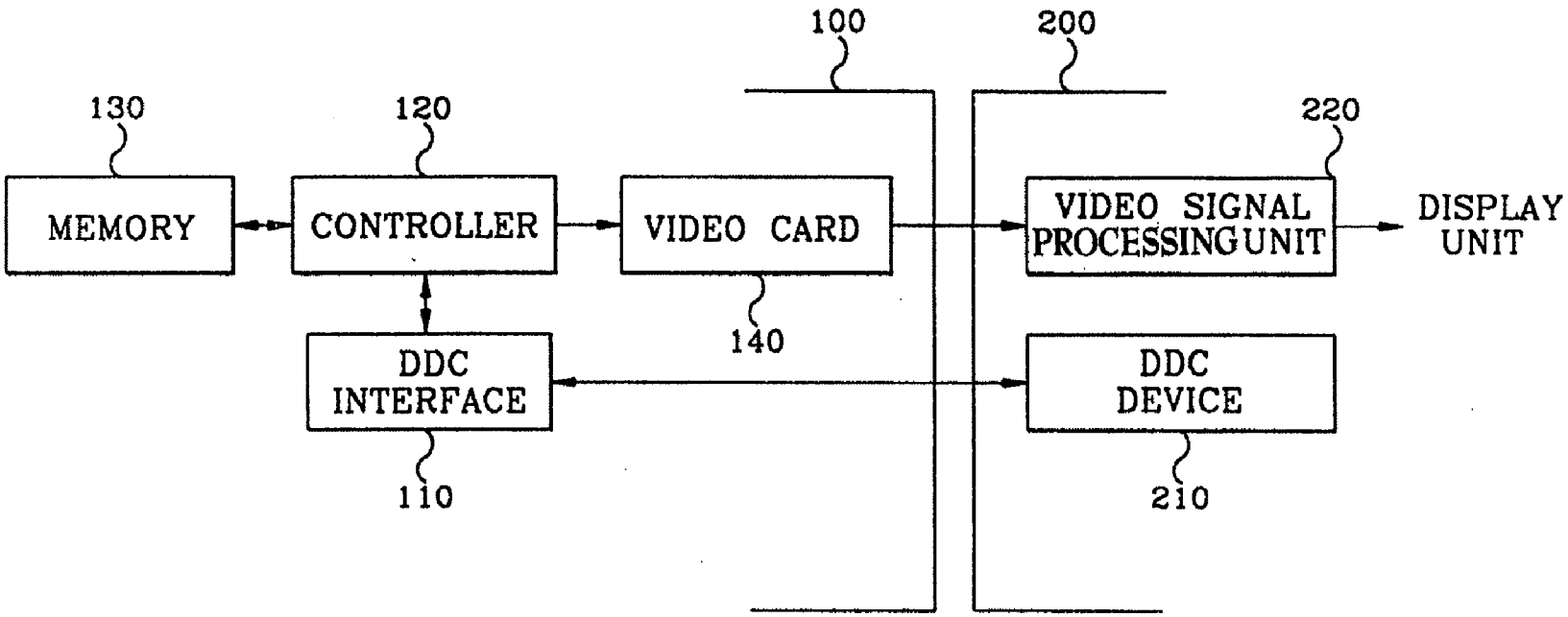
FIG. 1 is a block diagram showing a signal connection between a display apparatus and a main body of a computer including a digital data communication (DDC) function.

Turn now to FIG. 1, which is a block diagram showing a signal connection between a display apparatus and a main body of a computer including a digital data communication (DDC) function. The DDC also represents Display Data Channel. FIG. 1 includes a main body 100 of a computer and a display apparatus 200. The main body 100 of the computer includes a memory 130 for storing software or various data required for proper operation of the main body 100; a digital data communication (DDC) interface 110 for being controlled by a controller 120 and for serving as a signal-interface for digital data communication; and a video card 140 for converting a video signal provided from the controller 120 to a transmit signal and transmitting it to the display apparatus 200.

The display apparatus 200 includes a video signal processing unit 220 for amplifying and outputting the video signal transmitted from the video card 140 of the main body of the computer 100 so as to display it on a screen, and a digital data communication (DD C) device 210 for storing information on the display apparatus 200 and transmitting it to the main body 100 of the computer through digital data communication.

Regarding FIG. 1, an operation of the block diagram of the signal connection between the display apparatus 200 and the main body 100 of the computer will now be described. When the display apparatus 200 is connected to the main body 100 of the computer by digital data communication, the digital data communication device 210 of the display apparatus 200 is actuated, and the information stored at the digital data communication device 210 is transmitted to the controller 120 through the digital data communication interface 110 of the main body 100 of the computer.

Upon receipt of the information on the display apparatus 200, the controller 120 reads to compare it with the information on the existing display apparatus as stored at the memory 130, and if they are not the same, the controller stores the newly input information instead of the existing information. And the controller 120 reads the resolution outputted to the video card 140 as a value corresponding to the newly connected display apparatus from the memory 130 for replacement. The video card 140 generates a horizontal and a vertical synchronous signals to be suitable to the information provided from the controller 120 and converts a video signal such as color signal into a suitable type for transmission.

The signal transmission from the main body 100 of computer to the display apparatus 200 can be either an analog signal or a digital signal type. Meanwhile, the video signal processing unit 220 of the display apparatus 200 converts the synchronous signal and the video signal transmitted from the video card 140 into a signal level suitable to the display apparatus 200, which is then amplified so as to display it on the screen of the display apparatus 200, and thereafter outputs it to the display apparatus 200 such as a cathode-ray tube or a liquid crystal display device.

Figure 2:
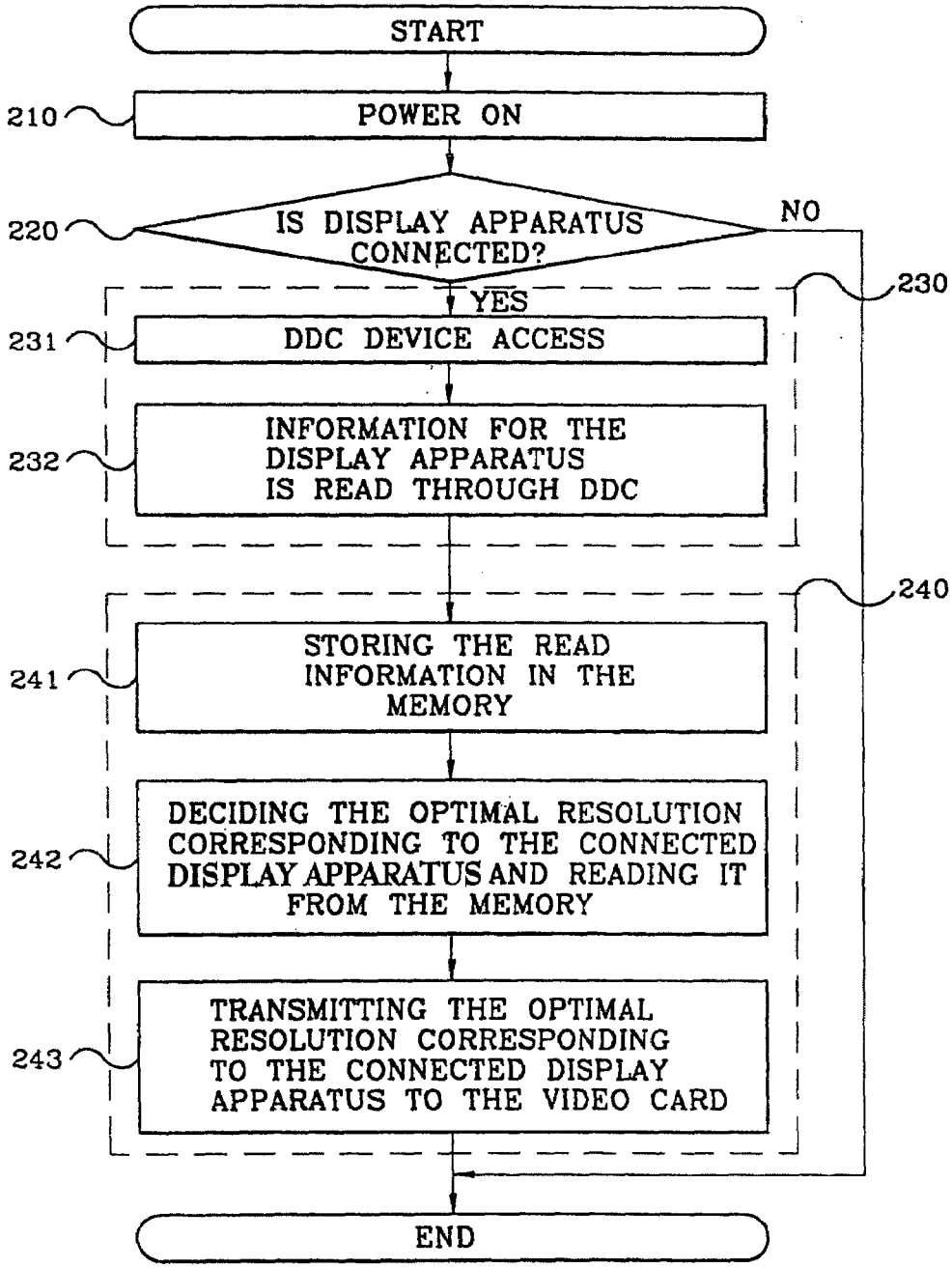
FIG. 2 is a flowchart showing an embodiment of a plug-and-play operation of the display apparatus connected to the main body of the computer of FIG. 1.

Turn now to FIG. 2, which is a flowchart showing an embodiment of a plug-and-play operation of the display apparatus connected to the main body of the computer of FIG. 1. At step S210, in order to perform a plug-and-play operation of the display apparatus 200 of FIG. 1, power is supplied to the main body 100 of the computer of FIG. 1. At step S220, a determination is made as to whether the display apparatus 200 is connected to the main body 100 of computer. After step S220, the step S230 is performed only if the display apparatus 200 is connected. After step S220, the process ends if the display apparatus 200 is not connected. At step S230, information pertaining to the display apparatus 200 is read from the digital data communication device 210 if the display apparatus 200 is connected. At step S240, resolution data corresponding to the information read from the digital data communication device 210 is transmitted to the video card 140 of FIG. 1. The above steps are controlled by the controller 120 of the main body 100 of computer. More detailed description follows pertaining to FIG. 2.

In FIG. 2, at step S210, power is supplied to the main body 100 of computer. At step S220, the controller 120 checks each port where peripheral equipment is connected to judge where they are connected to each port. For example, a voltage of a predetermined pin of a port where the display apparatus 200 is to be connected is checked, and then its connection is judged according to the size of the voltage.

In FIG. 2, at step S231, when the display apparatus 200 is connected to the main body 100 of the computer through digital data communication, the digital data communication device 210 of the display apparatus 200 is accessed. At step S232, various information for the display apparatus 200 is read through the digital data communication interface 110.

The digital data communication device 210 is a semiconductor device which stores information such as a product company and a size of the display apparatus where it is inserted. Reading information as stored at the digital data communication device is only possible through this digital data communication device 210.

At step S240, after reading the information of the display apparatus 200 from the digital data communication device 210, the controller 120 controls a transmitting of the resolution corresponding to the information as read to the video card 140. At step S241, the transmitting of the resolution is performed in such a way that first read information is stored at the memory 130, and then, at step S242, the optimal resolution corresponding to the connected display apparatus 200 is determined and then is read from the memory 130. At step S243, the optimal resolution corresponding to the connected display apparatus 200 is transmitted to the video card 140.

However, as to the plug-and-play function between the main body 100 of computer and the display apparatus 200 controlled as described above, the main body 100 of the computer recognizes the display apparatus 200 only when the power is initially applied to the main body 100 of the computer so that the main body 100 of the computer can be initialized, which causes a problem in case that the display apparatus 200 is replaced while the main body 100 of the computer is being operated, in that the display apparatus 200 cannot be initialized. That is, plug-and-play function can be performed, while the hot-plugging function is not available.

Figure 3:
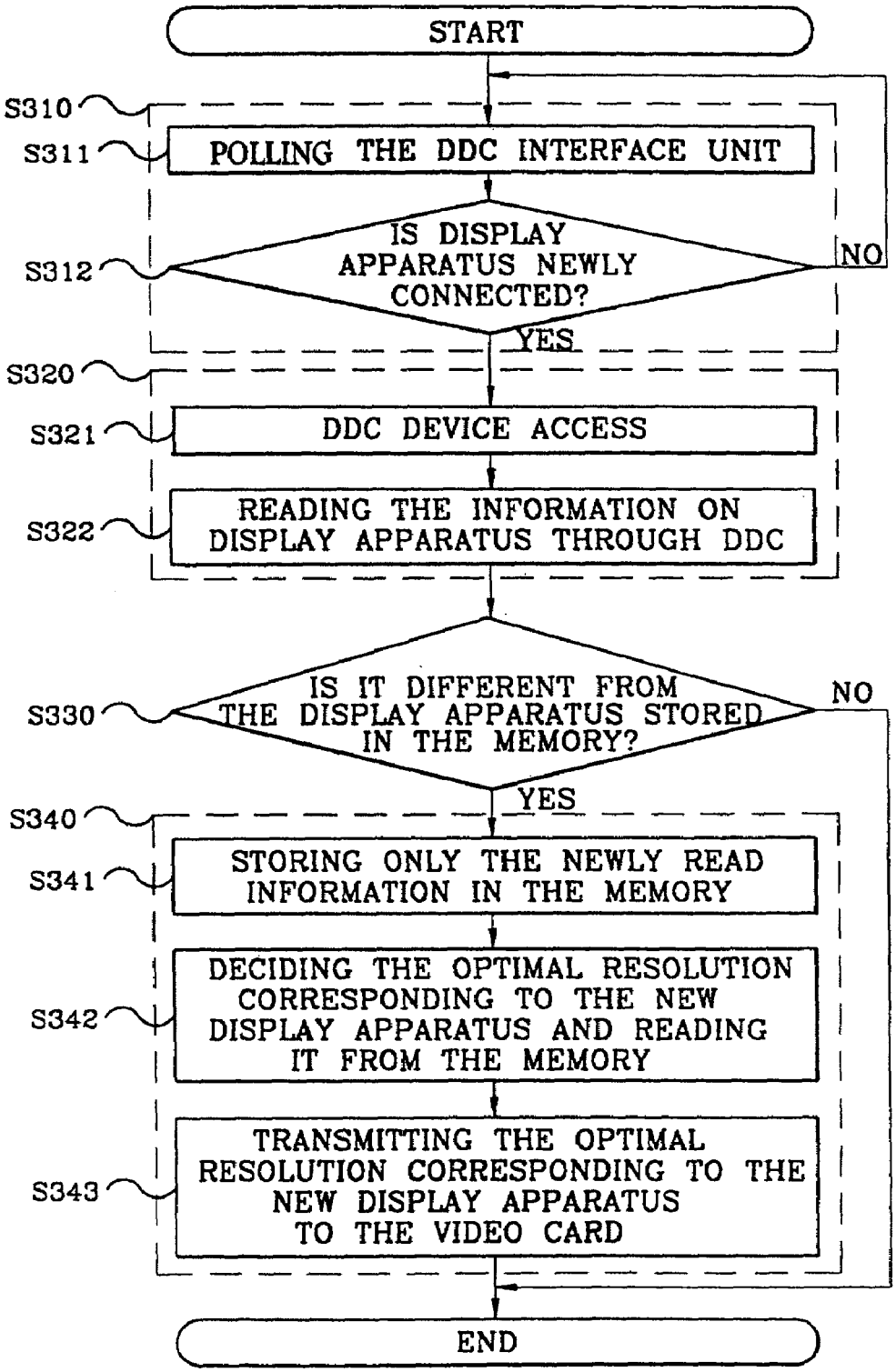
FIG. 3 is a flowchart showing a first embodiment of hot-plugging of the display apparatus, in accordance with the principles of the present invention.

A preferred embodiment of the present invention will now be described with reference to the accompanying drawings. Turn now to FIG. 3, which is a flowchart showing a first embodiment of hot-plugging of the display apparatus, in accordance with the principles of the present invention. As shown in FIG. 3, the hot-plugging method of a display apparatus includes the following steps. At step S310, a determination is made as to whether a new display apparatus is connected while a main body of a computer is being driven. At step S320, reading information on the display apparatus is read by means of a predetermined data communication in case that the display apparatus is newly connected to the main body of the computer. At step S330, a determination is made as to whether the read information is identical to the existing information as stored at a memory. At step S340, storing the read information to the memory if the two information are not identical to each other according to the determination of step S330, determining an optimal resolution corresponding to the newly connected display apparatus, and transmitting the optimal resolution to a video card, which is performed by a controller 120 (as shown in FIG. 1). More details regarding FIG. 3 are provided below.

In FIG. 3, at step S310, it is judged whether the display apparatus 200 is newly connected by replacement while the main body 100 of the computer is being driven in a way that a voltage variation of a predetermined pin of a port for digital data communication is checked by successively polling a digital data communication interface 110 in a constant time interval. Therefore, at step S311, a successive polling of a digital data communication interface unit 110 is performed. Then at step S312, a determination is made as to whether a new display apparatus has been connected. At this time, the judgement of whether the display apparatus is connected or not is made not only while the main body 100 of the computer is being driven but when a power is applied to the main body of the computer.

At step S320, when the display apparatus 200 is newly connected to the main body of the computer, a step for reading information on the display apparatus 200 by means of a predetermined data communication is performed in a way that the digital data communication device 210 is first accessed and then the information is read through the digital data communication interface 110. Therefore, at step S321, a digital data communication device 210 is accessed. Then at step S322, information pertaining to the newly attached display apparatus is read from the digital data communication device 210.

In FIG. 3 at step S330, upon reading the information of the display apparatus 200 from the digital data communication device 210, the newly read information and the information as previously stored at the memory 130 are compared so as to determine whether they are the same. At step S341, if the newly read information and the previously stored information are deemed to be not the same, then the newly read information is stored at the memory 130. At step S342, the optimal resolution corresponding to the new display apparatus 200 is determined and read from the memory 130. At step S343, the optimal resolution is transmitted to the video card 140.

Figure 4:
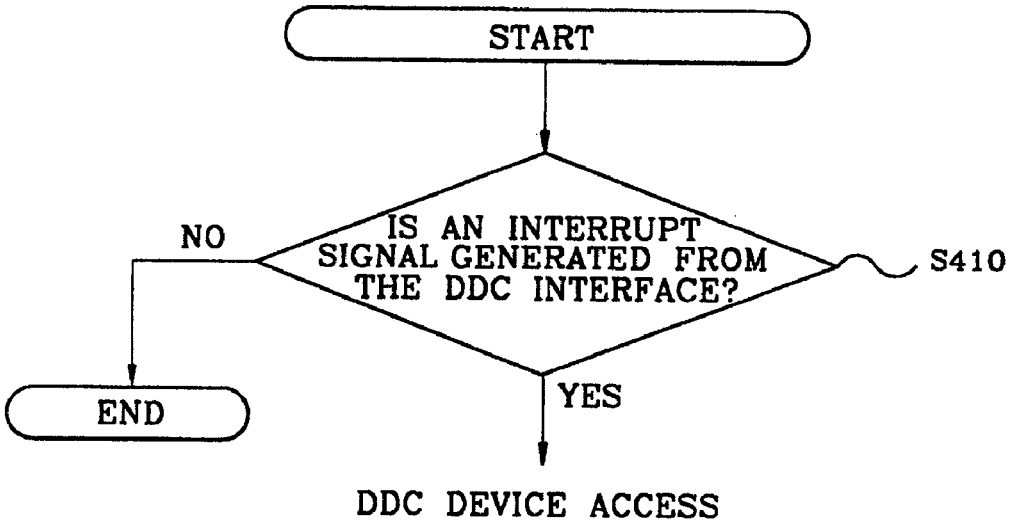
FIG. 4 is a flowchart showing a second embodiment for judging whether the display apparatus is connected, in accordance with the principles of the present invention.

Turn now to FIG. 4, which is a flowchart showing a second embodiment for judging whether the display apparatus is connected, in accordance with the principles of the present invention. It is helpful to refer to FIGS. 3 and 4 together. In the control process as shown in FIG. 3, the judgement as to whether or not the display apparatus 200 is connected to the main body 100 of the computer is made in a way that a voltage variation of a predetermined pin of a port for the digital data communication is checked by repeatedly polling the digital data communication interface 110 in a constant time interval. This control process was previously described during the discussion of steps S310, S311, and S312 above.

However, step S410 comprises an alternative to steps S310, S311, and S312. Thus, in FIG. 4 at step S410, there can be used a method for checking whether an interrupt signal is generated and inputted from the digital data communication interface 110 to the controller 120.

An example of step S410 in FIG. 4 is as follows. When the voltage of the predetermined pin of the port for digital data communication is varied, which is interpreted as a new display apparatus 200 being newly connected to the main body 100 of the computer, then the digital data communication interface 110 outputs a predetermined interrupt signal to the controller 120.

While the display apparatus is performing the hot-plugging, when the display apparatus 200 is newly connected to the main body of the computer, a predetermined data communication, that is, a communication means, for reading information on the display apparatus 200 may be any other communication means for use including a radio communication such as infrared if they are able to transmit data besides the digital data communication as shown in FIG. 1. Thus, infrared signals and other types of signals may be used for the communication among the devices depicted in FIG. 1.

Figure 5:
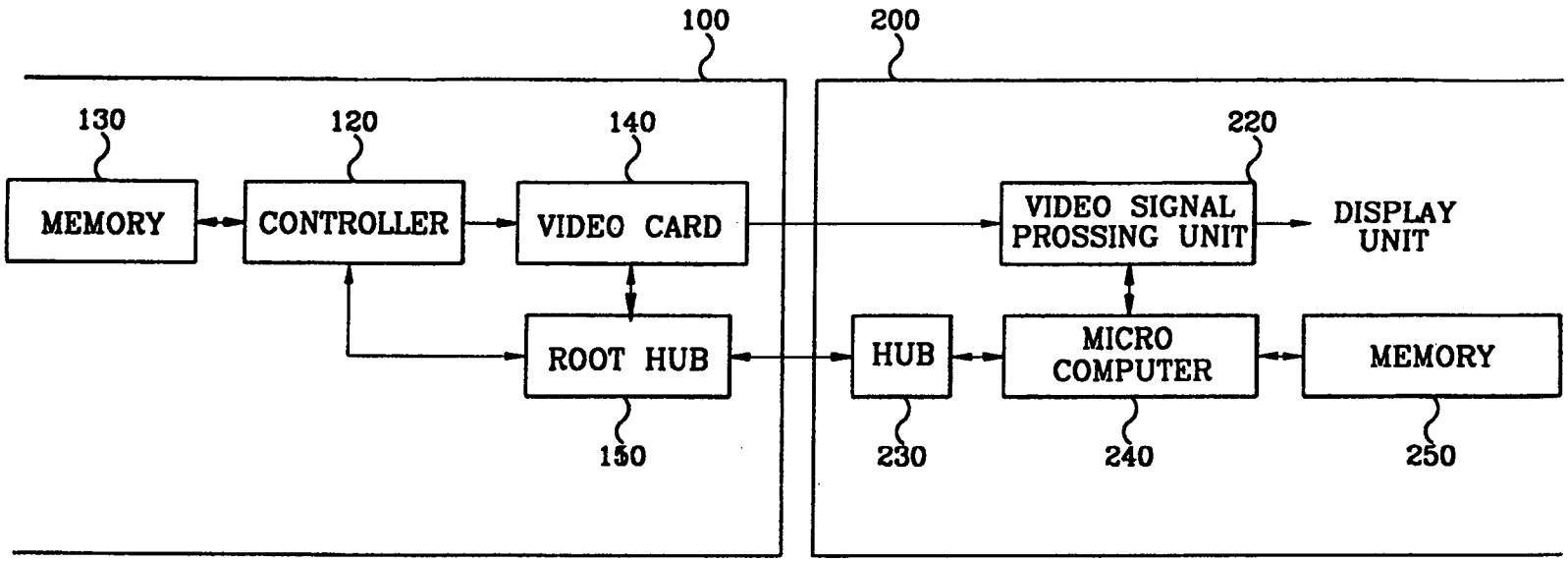
FIG. 5 is a block diagram showing a signal connection between the display apparatus and the main body of a computer including a communication using a universal serial bus (USB), in accordance with the principles of the present invention.

Turn now to FIG. 5, which is a block diagram showing a signal connection between the display apparatus and the main body of a computer including a communication using a universal serial bus (USB), in accordance with the principles of the present invention. FIG. 5 does not include the digital data communication device 210 and the digital data communication interface 110 depicted in FIG. 1 for performing digital data communication. Instead of the DDC device 210 and the DDC interface 110, the main body 100 of the computer of FIG. 5 includes a root hub 150 in the main body 100 of the computer, along with a hub 230 and a memory 250 in the display apparatus 200, in order to perform communication using universal serial bus (USB).

In FIG. 5, the memory 250 is a device for storing information pertaining to the display apparatus 200. Thus, memory 250 in FIG. 5 performs a function similar to the function performed by the digital data communication device 210 in FIG. 1.

In FIG. 5, the root hub 150 and the hub 230 are elements essentially provided to the main body 100 of the computer and the display apparatus 200 for the communication using universal serial bus, thus performing effectively the same functions as the interface which enables the communication between instruments. The root hub 150 serves to control the hub 230 during universal serial bus communications.

In FIG. 5, the microcomputer 240 wholly controls operations of each constructive element as described above. Namely, when the display apparatus 200 is connected to the main body 100 of the computer, the microcomputer 240 reads the information on the display apparatus 200 from the memory 250 and transmits it to the controller 120 in the main body 100 of the computer through the hub 230 and to the root hub 150 via the universal serial bus communications cable coupling the hub 230 and the root hub 150.

An overview of the universal serial bus is shown below. A computer system has peripheral devices connected, such as a monitor and keyboard. A user might want to use additional peripheral devices, such as a mouse, modem, printer, and scanner. When a user tries to use multiple peripheral devices with a computer, it can be difficult to connect them since each peripheral typically has a unique type of connector. The user must carefully match the plug from each peripheral with a corresponding connector on the computer due to all the different connector types. Also, it can be difficult to configure the computer to communicate with all the peripheral devices due to the fact that some peripheral devices require unique types of hardware and software. To solve the above described problems, a universal serial bus (USB) system has been developed. The universal serial bus is a basic system for connecting peripheral devices to a computer. Peripheral devices connected to a universal serial bus system are also referred to as universal serial bus peripheral devices. All USB devices are compatible with standard USB cables and standard USB connectors in order to simplify the process of connecting devices to a computer system. A keyboard or monitor can be directly connected to a computer or a universal serial bus within the computer. Other peripheral devices can be easily connected to the computer with the use of an expanded hub built into the keyboard or monitor, or even via an independent universal serial bus. The expanded hub offers additional connection sockets, and can be connected in a hierarchical tree form. Peripheral devices may be located close to each other or can be located several meters from each other, with the use of a universal serial bus hub. A universal serial bus is able to connect a total of 127 USB devices to one computer. The operating voltage transmitted through the universal serial bus is limited to 5 volts. Thus, peripherals connected on a universal serial bus are limited in the amount of power they can consume. A rapid data transmission rate of 12 megabits per second on the universal serial bus is one of the advantageous features of the universal serial bus. The major advantages of the universal serial bus include the simplicity and convenience of attaching and detaching peripheral devices to the computer. The universal serial bus detects whether a device is added or removed when related information is offered from a computer. The USB devices can be added to a computer system or removed from a computer system while the computer system is on, unlike non-USB configurations, thus eliminating the need for a reboot of the computer system.

The display apparatus 200 depicted in FIGS. 1 and 5 can be a cathode ray tube, a liquid crystal display, a gas-plasma display, a light emitting diode display, an electro-luminescent display, a field emission display, or any other type of video display.

As described above, according to hot-plugging method of display apparatus, in case of replacing the display apparatus 200 to be connected to the main body 100 of the computer, the main body 100 of the computer automatically recognizes the newly connected display apparatus 200 and provides an initializing method, so that the newly connected display apparatus 200 can be normally operated without re-operating the main body 100 of the computer. Thus, the main body 100 of the computer does not need to be rebooted in order to attach a new monitor.

The foregoing paragraphs describe a method for recognizing whether a display apparatus is newly connected to a main body of a computer, and more particularly, a hot-plugging method for display apparatus which is capable of judging whether a display apparatus is replaced with another by polling or interrupting, and if it is replaced, reading data of the replaced display apparatus by means of a predetermined data communication, and initializing the main body of the computer to fit the replaced display apparatus.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A method of hot-plugging a video display unit to a computer, comprising the steps of:

providing the computer with a processing unit, a memory unit connected to said processing unit a digital data communication (DDC) interface connected to said processing unit, and a video card connected to said processing unit and coupled to said video display unit;

while power is being supplied to said processing unit, detecting whether said video display unit is newly coupled to said processing unit, said video display unit conveying varying visual information to a user, and said processing unit processing data including the varying visual information;

when said video display unit is detected as being newly coupled to said processing unit while power is being supplied to said processing unit, operating said DDC interface and said processing unit to read first data corresponding to said video display unit from said video display unit;

determining whether said first data corresponds to second data stored in said memory unit; and when said first data does not correspond to said second data stored in said memory unit, storing said first data in said memory unit, determining a resolution corresponding to said video display unit, and transmitting said resolution to said video card coupled to said video display unit;

said detecting step comprising operating said processing unit to carry out a polling operation periodically with respect to said DDC interface so as to determine whether said video display unit is newly coupled to said processing unit.

2. The method of claim 1, said detecting whether said video display unit is newly coupled to said processing unit comprising detecting whether a hot-plugging of said video display unit occurs.

3. The method of claim 2, said hot-plugging of said video display unit comprising connecting said video display unit to said processing unit after a booting process of said processing unit is completed.

4. The method of claim 1, said detecting being performed after a booting process of said processing unit is completed.

5. The method of claim 1, said polling operation being performed after a booting process of said processing unit is completed.

6. A method of hot-plugging a video display unit to a computer, comprising:

providing the computer with a processing unit, a memory unit connected to said processing unit, a digital data communication (DDC) interface connected to said processing unit, and a video card connected to said processing unit and coupled to said video display unit;

while power is being supplied to said processing unit, detecting whether said video display unit is newly coupled to said processing unit, said video display unit conveying varying visual information to a user, and said processing unit processing data including the varying visual information;

when said video display unit is detected as being newly coupled to said processing unit while power is being supplied to said processing unit, operating said DDC interface and said processing unit to read first data corresponding to said video display unit from said video display unit;

determining whether said first data corresponds to second data stored in said memory unit; and when said first data does not correspond to said second data stored in said memory unit, storing said first data in said memory unit, determining a resolution corresponding to said video display unit, and transmitting said resolution to said video card coupled to said video display unit;

said detecting step comprising operating said processing unit to carry out a polling operation periodically with respect to said DDC interface so as to determine whether said video display unit is newly coupled to said processing unit, said detecting step being performed while power is being newly supplied to said processing unit.

7. The method of claim 6, said detecting whether said video display unit is newly coupled to said processing unit comprising detecting whether a hot-plugging of said video display unit occurs.

8. The method of claim 7, said hot-plugging of said video display unit comprising connecting said video display unit to said processing unit after a booting process of said processing unit is completed.

9. The method of claim 6, said detecting being performed after a booting process of said processing unit is completed.

10. The method of claim 6, said polling operation being performed after a booting process of said processing unit is completed.

11. A method of hot-plugging a video display unit to a computer, comprising:

providing the computer with a processing unit, a memory unit connected to said processing unit, a digital data communication (DDC) interface connected to said processing unit, and a video card connected to said processing unit and coupled to said video display unit;

while power is being supplied to said processing unit, detecting whether said video display unit is newly coupled to said processing unit, said video display unit conveying varying visual information to a user, and said processing unit processing data including the varying visual information;

when said video display unit is detected as being newly coupled to said processing unit while power is being supplied to said processing unit, operating said DDC interface and said processing unit to read first data corresponding to said video display unit from said video display unit;

determining whether said first data corresponds to second data stored in said memory unit; and when said first data does not correspond to said second data stored in said memory unit, storing said first data in said memory unit, determining a resolution corresponding to said video display unit, and transmitting said resolution to said video card coupled to said video display unit;

said detecting step comprising operating said processing unit to carry out a polling operation periodically with respect to said DDC interface so as to determine whether said video display unit is newly coupled to said processing unit, said detecting step being performed after power has been newly supplied to said processing unit.

12. The method of claim 11, said detecting whether said video display unit is newly coupled to said processing unit comprising detecting whether a hot-plugging of said video display unit occurs.

13. The method of claim 12, said hot-plugging of said video display unit comprising connecting said video display unit to said processing unit after a booting process of said processing unit is completed.

14. The method of claim 11, said detecting being performed after a booting process of said processing unit is completed.

15. The method of claim 11, said polling operation being performed after a booting process of said processing unit is completed.

16. A method of hot-plugging a video display unit to a computer, comprising:

providing the computer with a processing unit, a memory unit connected to said processing unit, a digital data communication (DDC) interface connected to said processing unit, and a video card connected to said processing unit and coupled to said video display unit:

while power is being supplied to said processing unit, detecting whether said video display unit is newly coupled to said processing unit, said video display unit conveying varying visual information to a user, and said processing unit processing data including the varying visual information;

when said video display unit is detected as being newly coupled to said processing unit while power is being supplied to said processing unit, operating said DDC interface and said processing unit to read first data corresponding to said video display unit from said video display unit;

determining whether said first data corresponds to second data stored in said memory unit;

when said first data does not correspond to said second data stored in said memory unit, storing said first data in said memory unit, determining a resolution corresponding to said video display unit, and transmitting said resolution to said video card coupled to said video display unit;

said detecting step comprising a sensing of an interrupt signal generated by said DDC interface when said video display unit is newly coupled to said processing unit, said detecting step being performed while power is being newly supplied to said processing unit.

17. The method of claim 16, said detecting whether said video display unit is newly coupled to said processing unit comprising detecting whether a hot-plugging of said video display unit occurs.

18. The method of claim 17, said hot-plugging of said video display unit to comprising connecting said video display unit to said connecting processing unit after a booting process of said processing unit is completed.

19. The method of claim 16, said detecting being performed after a booting process of said processing unit is completed.

20. The method of claim 16, said sensing of said interrupt signal being performed after a booting process of said processing unit is completed.

21. A method of hot-plugging a video display unit to a computer, comprising:

providing the computer with a processing unit, a memory unit connected to said processing unit, a digital data communication (DDC) interface connected to said processing unit, and a video card connected to said processing unit and coupled to said video display unit;

while power is being supplied to said processing unit, detecting whether said video display unit is newly coupled to said processing unit, said video display unit conveying varying visual information to a user, and said processing unit processing data including the varying visual information;

when said video display unit is detected as being newly coupled to said processing unit while power is being supplied to said processing unit, operating said DDC interface and said processing unit to read first data corresponding to said video display unit from said video display unit;

determining whether said first data corresponds to second data stored in said memory unit;

when said first data does not correspond to said second data stored in said memory unit, storing said first data in said memory unit, determining a resolution corresponding to said video display unit, and transmitting said resolution to said video card coupled to said video display unit; and said detecting step comprising a sensing of an interrupt signal generated by said DDC interface when said video display unit is newly coupled to said processing unit, said detecting step being performed after power has been newly supplied to said processing unit.

22. The method of claim 21, said detecting whether said video display unit is newly coupled to said processing unit comprising detecting whether a hot-plugging of said video display unit occurs.

23. The method of claim 22, said hot-plugging of said video display unit comprising connecting said video display unit to said processing unit after a booting process of said processing unit is completed.

24. The method of claim 21, said detecting being performed after a booting process of said processing unit is completed.

25. The method of claim 21, said sensing of said interrupt signal being performed after a booting process of said processing unit is completed.

26. A method of hot-plunging a video display unit to a computer, comprising:

providing the computer with a processing unit, a memory unit connected to said processing unit, a digital data communication (DDC) interface connected to said processing unit, and a video card connected to said processing unit and coupled to said video display unit:

connecting said video display unit to said computer after said computer has been initialized and while said computer is being operated by a user, said video display unit conveying varying visual information to the user;

detecting whether said video display unit is connected to said computer;

when said video display unit is detected as being connected to said computer, operating said DDC interface and said processing unit to read first data corresponding to said video display unit from said video display unit; and transmitting resolution data to said video card coupled to said video display unit, said resolution data corresponding to said first data.

27. The method of claim 26, said connecting, detecting, operating, and transmitting steps being performed without rebooting said computer.

28. The method of claim 27, said detecting step comprising operating said processing unit to carry out a polling operation periodically with respect to said DDC interface so as to sense when said video display unit is connected to said computer.

29. The method of claim 26, said detecting step comprising operating said processing unit to carry out a polling operation periodically with respect to said DDC interface so as to sense when said video display unit is connected to said computer.

30. The method of claim 26, said detecting step comprising a sensing of an interrupt signal generated by said DDC interface when said video display unit is connected to said computer.

31. A method of hot-plugging a video display unit to a computer, comprising:

providing the computer with a processing unit, a memory unit connected to said processing unit, a digital data communication (DDC) interface connected to said processing unit and a video card connected to said processing unit and coupled to said video display unit:

powering on said computer;

connecting said video display unit to said computer after said powering on of said computer, said video display unit conveying varying visual information to a user;

detecting whether said video display unit is connected to said computer;

when said video display unit is detected as being connected to said computer, operating said DDC interface and said processing unit to read first data corresponding to said video display unit from said video display unit; and transmitting resolution data to said video card coupled to said video display unit, said resolution data corresponding to said first data.

32. The method of claim 31, said connecting, detecting, operating, and transmitting steps being performed without restarting said computer.

33. The method of claim 32, said detecting step comprising operating said processing unit to carry out a polling operation periodically with respect to said DDC interface to sense when said video display unit is connected to said computer.

34. The method of claim 31, said detecting step comprising operating said processing unit to carry out a polling operation periodically with respect to said DDC interface to sense when said video display unit is connected to said computer.

35. The method of claim 31, said detecting step comprising a sensing of an interrupt signal generated by said DDC interface when said video display unit is connected to said computer.

36. An apparatus, comprising:

a computer system for processing data; and a video display unit for conveying varying visual information to a user, said video display unit being connected to said computer system after said computer system has been powered on and initialized;

said computer system including a processing unit installed in said computer system, a digital data communication (DDC) interface connected to said processing unit and a video card connected to said processing unit and coupled to said video display unit;

said processing unit processing the data including the visual information, said processing unit detecting whether said video display unit is connected to said computer system, said processing unit operating said DDC interface to read first data corresponding to said video display unit when said video display unit is detected, said processing unit determining whether said first data corresponds to second data stored in said computer system, said processing unit storing said first data, determining resolution data corresponding to said video display unit, and transmitting said resolution data when said first data does not correspond to said second data.

37. The apparatus of claim 36, said video card being disposed between said processing unit and said video display unit, said video card receiving said resolution data transmitted from said processing unit.

38. The apparatus of claim 36, further comprising:

a first memory installed in said video display unit, said processing unit reading said first data from said first memory; and a second memory installed in said computer system, said second data being stored in said second memory;

said processing unit storing said first data in said second memory when said first data does not correspond to said second data.

39. The apparatus of claim 38, said detecting performed by said processing unit comprising operating said processing unit to carry out a polling operation periodically with respect to said DDC interface so as to sense when said video display unit is connected to said computer system.

40. The apparatus of claim 36, said resolution data corresponding to an optimal resolution of said video display unit.

41. The apparatus of claim 36, wherein said video display unit comprises one of a cathode ray tube, a liquid crystal display, a gas-plasma display, a light emitting diode display, an electro-luminescent display, and a field emission display.

42. The apparatus of claim 36, said detecting performed by said processing unit comprising operating said processing unit to carry out a polling operation periodically with respect to said DDC interface so as to sense when said video display unit is connected to said computer system.

43. An apparatus, comprising:

a computer system for processing data; and a video display unit for conveying varying visual information to a user, said video display unit being connected to said computer system after said computer system has been booted;

said computer system including a processing unit being installed in said computer system, a digital data communication (DDC) interface connected to said processing unit and a video card connected to said processing unit and coupled to said video display unit;

said processing unit processing the data including the visual information, said processing unit detecting whether said video display unit is connected to said computer system, said processing unit operating said DDC interface to read first data corresponding to said video display unit and transmitting resolution data corresponding to said first data.

44. The apparatus of claim 43, said video card being disposed between said processing unit and said video display unit, said video card receiving said resolution data transmitted from said processing unit.

45. The apparatus of claim 43, further comprising a first memory installed in said video display unit, said processing unit reading said first data from said first memory.

46. The apparatus of claim 43, said resolution data corresponding to an optimal resolution of said video display unit.

47. The apparatus of claim 43, said processing unit performing said detecting, operating, and transmitting without restarting said computer system.

48. The apparatus of claim 47, said detecting performed by said processing unit comprising operating said processing unit to carry out a polling operation periodically with respect to said DDC interface so as to sense when said video display unit is connected to said computer system.

49. The apparatus of claim 43, said detecting performed by said processing unit comprising operating said processing unit to carry out a polling operation periodically with respect to said DDC interface so as to sense when said video display unit is connected to said computer system.

50. The apparatus of claim 43, said detecting performed by said processing unit including a sensing of an interrupt signal generated by said DDC interface when said video display unit is connected to said computer system.

51. A method of hot-plugging a video display unit to a computer, comprising:

providing the computer with a processing unit a memory unit connected to said processing unit, a digital data communication (DDC) interface connected to said processing unit, and a video card connected to said processing unit and coupled to said video display unit;

connecting said video display unit to said computer after said computer has been powered on and initialized, said video display unit conveying varying visual information to a user;

detecting whether said video display unit is connected to said computer;

when said video display unit is detected as being connected to said computer, operating said DDC interface and said processing unit to read first data corresponding to said video display unit;

determining whether said first data corresponds to second data stored in said memory unit; and when said first data does not correspond to said second data stored in said memory unit, storing said first data in said memory unit, identifying a resolution corresponding to said video display unit, and transmitting said resolution to said video card coupled to said video display unit.

52. The method of claim 51, said connecting, detecting, operating, determining, storing, identifying, and transmitting steps being performed without rebooting said computer.

53. The method of claim 52, said detecting step comprising operating said processing unit to carry out a polling operation periodically with respect to said DDC interface so as to sense when said video display unit is connected to said computer.

54. The method of claim 51, said detecting step comprising operating said processing unit to carry out a polling operation periodically with respect to said DDC interface so as to sense when said video display unit is connected to said computer system.

55. The method of claim 51, said detecting step comprising a sensing of an interrupt signal generated by said DDC interface when said video display unit is connected to said computer.

* * * * *